US012433430B2

(12) United States Patent
Lambert

(10) Patent No.: US 12,433,430 B2
(45) Date of Patent: Oct. 7, 2025

(54) PICTURE FRAME AND SUPPORT SYSTEM

(71) Applicant: Steven Gerald Lambert, Orange, CA (US)

(72) Inventor: Steven Gerald Lambert, Orange, CA (US)

( * ) Notice: Subject to any disclaimer, the term of this patent is extended or adjusted under 35 U.S.C. 154(b) by 174 days.

(21) Appl. No.: 18/395,991

(22) Filed: Dec. 26, 2023

(65) Prior Publication Data

US 2024/0206651 A1 Jun. 27, 2024

Related U.S. Application Data

(60) Provisional application No. 63/477,340, filed on Dec. 27, 2022.

(51) Int. Cl.
*A47G 1/14* (2006.01)

(52) U.S. Cl.
CPC ..... *A47G 1/142* (2013.01)

(58) Field of Classification Search
CPC ..... A47G 1/142; A47G 2001/0677; A47G 2001/0694; A47G 1/06
See application file for complete search history.

(56) References Cited

U.S. PATENT DOCUMENTS 2,630,992 A * 3/1953 Seelman ..... A47G 1/142 40/746
4,216,936 A * 8/1980 DeSelms ..... A47G 1/142 248/909
4,432,152 A * 2/1984 Daenen ..... A47G 1/162 40/781
4,577,822 A 3/1986 Wilkerson
4,655,428 A * 4/1987 McCrea ..... A47G 1/142 40/761
4,704,814 A * 11/1987 Astolfi ..... A47G 1/142 40/761
4,776,117 A * 10/1988 Astolfi ..... A47G 1/142 40/761
4,979,323 A 12/1990 Wenkman et al.
(Continued)

FOREIGN PATENT DOCUMENTS

ES 1006501 12/1988
KR 20110003529 U 4/2011
(Continued)

OTHER PUBLICATIONS

International Preliminary Report on Patentability (Chapter II) dated Nov. 14, 2024, 4 pages.
(Continued)

*Primary Examiner* — Gary C Hoge
(74) *Attorney, Agent, or Firm* — INNOVATION CAPITAL LAW GROUP, LLP; Vic Lin

(57) ABSTRACT

A picture frame apparatus includes a frame body having a front face and a rear face. An exterior backing plate is configured to sit within a rear opening of the frame body. A slit in the exterior backing plate extends widthwise between a right side of the frame body and a left side of the frame body. A blade includes a proximal end and a distal end. The proximal end is positioned in the slit and the distal end projects outward from the exterior backing plate. The blade acts as a support element to prop the frame body up on a support surface.

20 Claims, 2 Drawing Sheets

(56) References Cited

U.S. PATENT DOCUMENTS

| | | | | |
|---|---|---|---|---|
| 5,077,921 | A * | 1/1992 | Mooney | G09F 1/12 40/761 |
| 5,101,586 | A * | 4/1992 | Zennedjian | A47G 1/142 40/761 |
| 2015/0132528 | A1* | 5/2015 | Pirayesh | B32B 3/08 347/110 |
| 2020/0046147 | A1* | 2/2020 | Green | A47G 1/142 |
| 2020/0268178 | A1 | 8/2020 | Coyle, Jr. et al. | |
| 2020/0397159 | A1* | 12/2020 | Haney | A47G 1/06 |
| 2021/0353076 | A1* | 11/2021 | Miller | A47G 1/143 |
| 2023/0145688 | A1* | 5/2023 | Hill | A47G 1/1606 40/713 |

FOREIGN PATENT DOCUMENTS

| | | | |
|---|---|---|---|
| KR | 20160002536 | U | 7/2016 |
| KR | 20170110179 | A | 10/2017 |

OTHER PUBLICATIONS

International Search Report & Written Opinion dated Apr. 12, 2024 from PCT Application No. PCT/US23/85896, 9 pages.

* cited by examiner

PICTURE FRAME AND SUPPORT SYSTEM

CROSS-REFERENCE TO RELATED APPLICATIONS

This application claims benefit under 35 U.S.C. § 119(e) of U.S. Provisional Application having Ser. No. 63/477,340 filed Dec. 27, 2022, which is hereby incorporated by reference herein in its entirety.

FIELD

The subject disclosure relates to display devices, and more particularly, to a picture frame and support system.

BACKGROUND

Picture frame systems conventionally include an empty frame in which backing supports a picture that can be seen through the front aperture of the frame. Some frames include a hook or support blade on the rear of the backing. Known support blades are generally attached on their proximal end by folding the proximal end flat to rest in abutment to the rear of the backing. The body of the support blade then extends diagonally from the fold so that the thin edge of the blade rests on a supporting surface such as a tabletop.

SUMMARY

In one aspect of the disclosure, a picture frame apparatus is disclosed. The apparatus includes a frame body having a front face and a rear face. An exterior backing plate is configured to sit within a rear opening of the frame body. A slit in the exterior backing plate extends widthwise between a right side of the frame body and a left side of the frame body. A blade includes a proximal end and a distal end. The proximal end is positioned in the slit and the distal end projects outward from the exterior backing plate. The blade acts as a support element to prop the frame body up on a support surface.

In another embodiment, a picture frame apparatus is disclosed. The apparatus includes a frame body having a front face and a rear face, and an opening for receiving a picture. The opening extends from the front face to the rear face. A slot in the frame body is accessible from the rear face. A rearward ledge is positioned on an interior of the frame body. An interior backing plate rests on the rearward ledge. The interior backing plate includes a storage chamber. An exterior backing plate rests over the interior backing plate. A slit in the exterior backing plate extends widthwise between a right side of the frame body and a left side of the frame body. The slit is aligned with the slot in the frame body. A blade includes a proximal end and a distal end. The proximal end is positioned in the slit and in the slot. The distal end projects outward from the exterior backing plate. The blade acts as a support element to prop the frame body up on a support surface.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

DETAILED DESCRIPTION

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be apparent to those skilled in the art that the subject technology may be practiced without these specific details. Like or similar components are labeled with identical element numbers for ease of understanding.

In general, and referring to the Figures, the subject apparatus is a picture frame 10. The picture frame 10 includes elements that improve on the support mechanisms of conventional picture frames. Moreover, it will be appreciated that picture frame 10 is versatile in how it is mounted onto vertical surfaces or supported on horizontal surfaces. In one embodiment, a horizontally disposed blade is included that provides improved support for pictures frames of the subject technology. as will be appreciated, the blade provides flexible and more stabilized support than conventional blades that use for example, edge-based support. Other features include hidden storage for the blade when wall mounting is preferred. For wall-mounting applications, the subject apparatus may include openings that may be revealed to receive hooks or nails, thus providing multiple options for using the apparatus.

Figure 1:
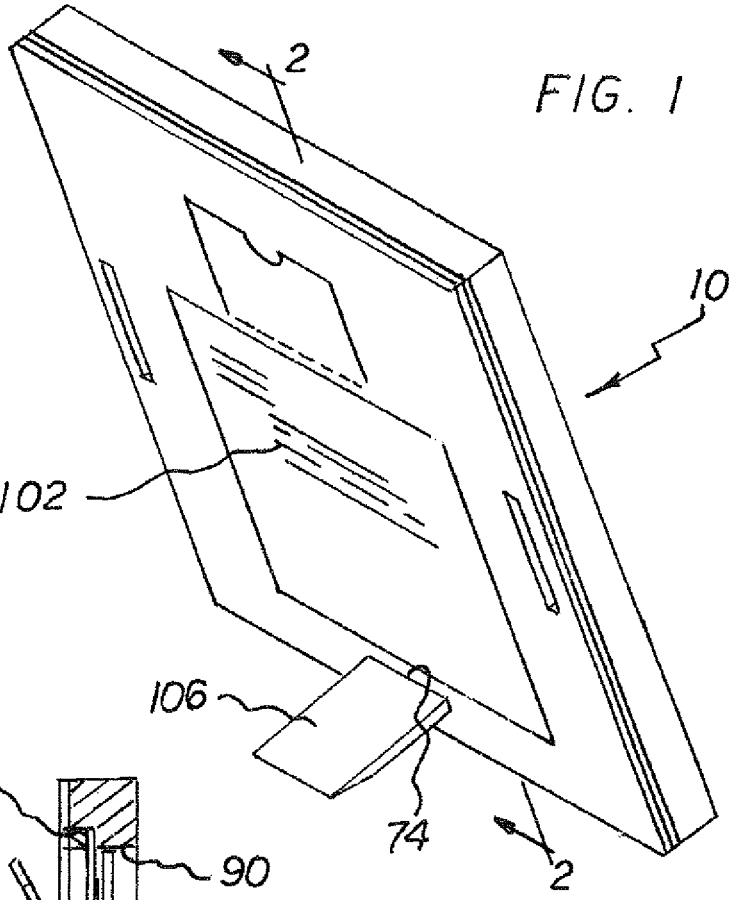
FIG. 1 is a perspective illustration of a picture frame in accordance with an exemplary embodiment.
Figure 2:
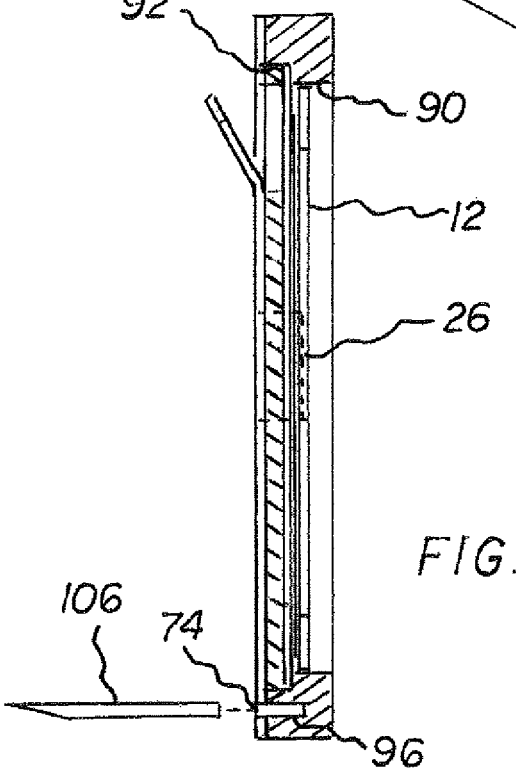
FIG. 2 is a cross sectional view taken along the line 2-2 of FIG. 1.
Figure 3:
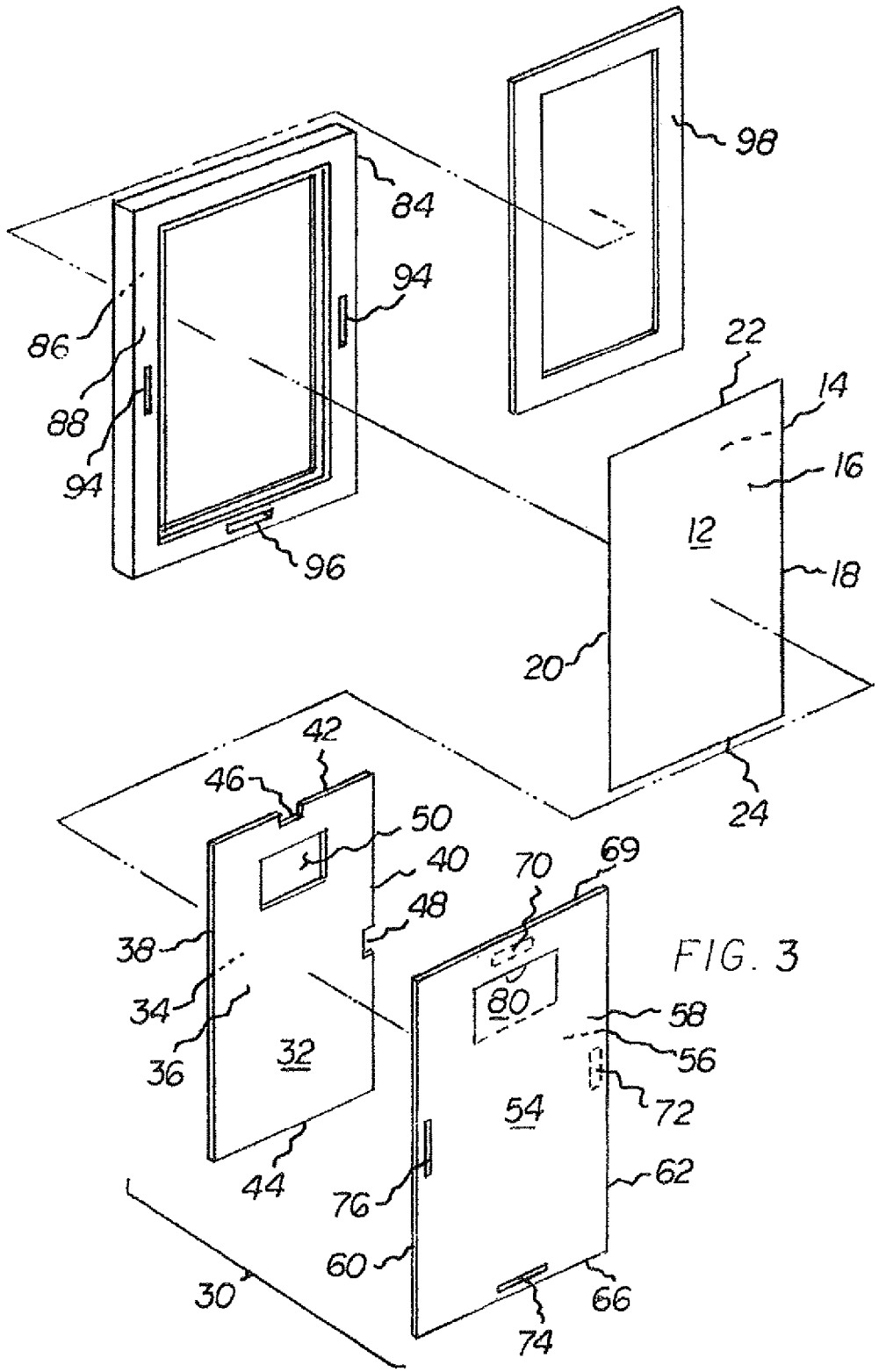
FIG. 3 is an exploded perspective view of the picture frame shown in FIGS. 1 and 2.

As shown in FIGS. 1-3, the picture frame 10 includes a frame body 84. The frame body 84 may comprise hollow framing that surrounds a central opening for the receipt of a picture 12. The frame body 84 may include a front face (or side) 86 and a rear face (or side) 88. A forward or front facing ledge 90 may be present on an interior edge of the framing. The forward or front facing ledge 90 may have a perimeter that is slightly smaller than a perimeter size of the picture 12 so that the picture 12 rests on the forward or front facing ledge 90 when assembled within the frame body 84. Some embodiments may include a mat 98 that may be positioned either between the picture 12 and the forward ledge 90 or between the picture 12 and a front interior edge of the framing.

As a point of reference, the picture 12 has a front face 14 and a rear face 16. The picture has a left side edge 18 and a right side edge 20. The picture has a top edge 22 and a bottom edge 24. The front face 14 of the picture 12 has an image 26 to be displayed. While the picture 12 is not necessarily part of the subject apparatus in some embodiments, the image 26 may serve as a point of reference when determining the relative direction of different elements described herein. For example, use of terms such as "forward", "rearward", "front", "back", "rear", "top", and "bottom" may be based on their individual position relative to the direction the image 26 faces.

The frame body 84 may include a rearward or rear facing ledge 92 on the interior edge of the framing. The rearward or rear facing ledge 92 will be used to hold other elements in the picture frame 10 as described further below, that help protect the picture 12 from the rear of the frame body 84 while providing a support element for mounting/support features.

Some embodiments include a rearward assembly 30. The rearward assembly 30 includes an interior backing plate 32 and an exterior backing plate 54. The interior backing plate 32 has a front face 34, a rear face 36, a left side edge 38, a right side edge 40, a top edge 42, and a bottom edge 44. The exterior backing plate 54 has a front face 56, a rear face 58, a left side edge 60, a right side edge 62, a top edge 64, and a bottom edge 66.

The frame body 84 may include a rearward ledge 92 that is on the interior edge of the framing and rearward of the forward ledge 90. As shown in FIG. 2, the rearward ledge 92 may have a height and width that are larger than the perimeter dimensions of the forward ledge 90. The interior backing plate 32 may be positioned to rest on the rearward ledge 92 so that the interior backing plate 32 is forward of the exterior backing plate 54 when assembled. The exterior backing plate 54 rests on the interior backing plate 32 when assembled so that the rear face 36 of the interior backing plate 32 may be in contact or directly facing the front face 56 of the exterior backing plate 54.

In some embodiments, the interior backing plate 32 may include notch 46 formed in the top edge 42. Some embodiments may include a notch 48 formed on one of the side edges 38 or 40. Notches 46 and 48 are for the passage of a nail used to hang the system on a wall. Some embodiments may include a cut out 50 in the interior backing plate 32. The cut out 50 will define an opening that serves as an inner storage chamber. While the cut out 50 is shown adjacent to the top edge 42, it will be understood that the cut out 50 can be placed anywhere on the interior backing plate 32 where the inner chamber is desired to be placed.

Some embodiments of the exterior backing plate 54 may include upper score lines 70 and side score lines 72. The score lines 70 and 72 overlie the notches 46 and 48 and hide the notches 46 and 48 when the picture frame 10 is set using horizontal support on a tabletop surface or other flat surface that is parallel to a floor. In the event a user wishes to use a vertical mounting (for example, hanging the picture frame 10 to a wall), one of the score lines 70 or 72 are punched out, exposing the underlying openings formed by the notches 46 or 48, to facilitate hanging the frame body 84 on a wall by a nail, hook, or other protruding fastener.

The picture frame 12 includes a blade 106 that is used to provide horizontal support of the frame body 84. The blade 106 maybe primarily flat and wide with a thin profile (for example, has side walls thinner than thew width of the top surface of the blade 106). Some embodiments of the exterior backing plate 54 include a cut out slit 74. The cut out slit 74 may extend widthwise between a right side of the frame body 84 and a left side of the frame body 84. In one embodiment, the slit 74 may be positioned adjacent the bottom edge 66. While the illustration shows positioning of the slit 74 near the bottom edge 66, other embodiments may position the slit 74 in other locations of the exterior backing plate 54. In use, the proximal end of the blade 106 is inserted into the cut out slit 74. The blade 106 may be detachable. The top surface of the blade 106 is parallel to a top side wall of the frame body 84. Being near the bottom edge 66, the blade 106 is relatively close to the horizontal support surface which helps with stability when the picture frame is used in a portrait orientation. Some embodiments of the frame body 84 include a slot 96 that is aligned with the slit 74 so that the proximal end of the blade 106 is supported by two elements thus providing reinforced stability to the picture frame 10. In some embodiments, the blade 106 includes a beveled bottom cut on the end that is distal from the exterior backing plate 54. The bevel cut helps to provide stability to the blade 106 by providing increased surface area that engages a supporting horizontal surface. Some embodiments of the exterior backing plate 54 may include a slit 76 proximate a side wall edge 60 or 62. The slit 76 may be used to receive the blade 106 when the user wishes to use the picture frame 10 in a landscape orientation.

In some embodiments, the exterior backing plate 54 includes a cover 80 overlying the cut out 50 in the interior backing plate 32. The cover 80 may be removable to provide access to the storage chamber provided by cut out 50 when a user wants to store the blade 106 (for example, when using a hanging configuration of the picture frame 10).

Some embodiments may include a field of text 102 relating to the image 26 positioned on the rear face 58 of the exterior backing plate 54 for viewing.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Those of skill in the art would appreciate that various components may be arranged differently (e.g., arranged in a different order, or partitioned in a different way) all without departing from the scope of the subject technology.

The previous description is provided to enable any person skilled in the art to practice the various aspects described herein. The previous description provides various examples of the subject technology, and the subject technology is not limited to these examples. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the invention.

Terms such as "top," "bottom," "front," "rear," "above," "below" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference. Similarly, an item disposed above another item may be located above or below the other item along a vertical, horizontal or diagonal direction; and an item disposed below another item may be located below or above the other item along a vertical, horizontal or diagonal direction.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. A picture frame apparatus, comprising:

a frame body, including a front face and a rear face;

an exterior backing plate configured to sit within a rear opening of the frame body;

a slit in the exterior backing plate, extending widthwise between a right side of the frame body and a left side of the frame body; and a blade including a proximal end and a distal end, wherein the proximal end is positioned in the slit and the distal end projects outward from the exterior backing plate, wherein the blade acts as a support element to prop the frame body up on a support surface.

2. The picture frame apparatus of claim 1, wherein the blade includes a bottom bevel cut edge on the distal end.

3. The picture frame apparatus of claim 1, wherein a top surface of the blade is parallel to a top side wall of the frame body.

4. The picture frame apparatus of claim 3, wherein side walls of the blade are thinner than the top surface of the blade.

5. The picture frame apparatus of claim 1, wherein the blade is detachable from the slit in the backing plate.

6. The picture frame apparatus of claim 1, further comprising an interior backing plate positioned in the frame body, forward of the exterior backing plate.

7. The picture frame apparatus of claim 6, further comprising a storage chamber in the interior backing plate, configured to hold the blade, when the blade is not in use as a support element.

8. The picture frame apparatus of claim 6, further comprising a cover on the exterior backing plate, positioned to cover the chamber.

9. The picture frame apparatus of claim 6, further comprising a notch proximate a top edge of the interior backing plate, for receiving a nail to hang up the frame body.

10. The picture frame apparatus of claim 6, further comprising a notch proximate a side edge of the interior backing plate, for receiving a nail to hang up the frame body.

11. The picture frame apparatus of claim 6, further comprising a slot in a bottom portion of the frame body, wherein the slot is aligned with the slit in the exterior backing plate, to provide support in holding the blade in the frame body.

12. The picture frame apparatus of claim 6, further comprising a rearward ledge on a rear side of the frame body, wherein the rearward ledge is configured to receive an assembly including a picture, the interior backing plate, and the exterior backing plate.

13. The picture frame apparatus of claim 1, wherein the blade is disposed for horizontal engagement with an underlying support surface.

14. A picture frame apparatus, comprising:

a frame body, including a front face and a rear face, and an opening for receiving a picture, wherein the opening extends from the front face to the rear face;

a slot in the frame body and accessible from the rear face;

a rearward ledge positioned on an interior of the frame body;

an interior backing plate resting on the rearward ledge, wherein the interior backing plate includes a storage chamber;

an exterior backing plate resting over the interior backing plate;

a slit in the exterior backing plate, extending widthwise between a right side of the frame body and a left side of the frame body, wherein the slit is aligned with the slot in the frame body; and a blade including a proximal end and a distal end, wherein the proximal end is positioned in the slit and in the slot, and the distal end projects outward from the exterior backing plate, wherein the blade acts as a support element to prop the frame body up on a support surface.

15. The picture frame apparatus of claim 14, wherein the blade includes a bottom bevel cut edge on the distal end.

16. The picture frame apparatus of claim 14, wherein a top surface of the blade is parallel to a top side wall of the frame body.

17. The picture frame apparatus of claim 16, wherein side walls of the blade are thinner than the top surface of the blade.

18. The picture frame apparatus of claim 14, further comprising another slit in the exterior backing plate, oriented in a vertical disposition and configured to receive the blade so that the frame body is positioned in a landscape orientation.

19. The picture frame apparatus of claim 18, further comprising a storage chamber in the interior backing plate, configured to hold the blade, when the blade is not in use as a support element.

20. The picture frame apparatus of claim 19, further comprising a cover on the exterior backing plate, positioned to cover the chamber when the blade is being held in the chamber.

* * * * *